US011440339B2

(12) United States Patent
Magana

(10) Patent No.: US 11,440,339 B2
(45) Date of Patent: Sep. 13, 2022

(54) SOFT AND HARD PANEL ATTACHMENT

(71) Applicant: Martin Magana, San Jose, CA (US)

(72) Inventor: Martin Magana, San Jose, CA (US)

( * ) Notice: Subject to any disclaimer, the term of this patent is extended or adjusted under 35 U.S.C. 154(b) by 126 days.

(21) Appl. No.: 17/005,843

(22) Filed: Aug. 28, 2020

(65) Prior Publication Data

US 2022/0063325 A1 Mar. 3, 2022

(51) Int. Cl.
*B44C 1/28* (2006.01)
*B44C 5/04* (2006.01)

(52) U.S. Cl.
CPC ..... *B44C 1/28* (2013.01); *B44C 5/043* (2013.01); *B44C 5/0484* (2013.01)

(58) Field of Classification Search
CPC ..... B44C 1/28; B44C 5/043; B44C 5/0484; B65H 2402/515; B65H 69/068; B65H 69/043; B65H 69/06; B65H 57/003
See application file for complete search history.

(56) References Cited

U.S. PATENT DOCUMENTS 4,427,472 A * 1/1984 Trager ..... B44C 1/28 156/277
10,683,666 B1 * 6/2020 Mouriz ..... E04D 5/146
2008/0145131 A1 * 6/2008 Kister ..... C09G 1/08 401/7
2008/0256909 A1 * 10/2008 Streifel ..... B68C 1/02 54/44.1
2009/0049719 A1 * 2/2009 Compton ..... A41D 27/20 40/586
2010/0175815 A1 * 7/2010 Weder ..... B44C 3/02 156/163
2014/0102929 A1 * 4/2014 Moellers ..... B65D 69/00 206/425

FOREIGN PATENT DOCUMENTS

CN 213370279 U * 6/2021
JP 2014069613 A * 4/2014
KR 101831790 B1 * 2/2018

* cited by examiner

*Primary Examiner* — Babajide A Demuren
(74) *Attorney, Agent, or Firm* — Ivan Rozek; Savantek Patent Services

(57) ABSTRACT

A pliable panel and hard panel attachment method where a plurality of pliable panels, a thin metallic panel and a wood panel are joined together in a novel manner. The pliable panel can be textile, leather or flexible plastic. The pliable panels have one or more rows of laser cut apertures that allow a length of the sewing thread to sew the pliable panels together. The hard-thin metallic panel is capable of being sandwiched between the pliable panel and the wood panel. The pliable panel members have laser cut apertures that allow the thin metal panel to be seen through the apertures. The metal panel and the wood and pliable panel are held together by rivets. The sewing thread is inserted into the row of apertures in such a way that the resulting sewn pattern appears to be a continuous line of thread.

3 Claims, 3 Drawing Sheets

SOFT AND HARD PANEL ATTACHMENT

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of sewing methods and more specifically to pliable panel and hard panel attachment methods.

Pliable fabric panels have been sewn together for thousands of years. Generally, the sewer uses a needle to pierce two layers of material, and by causing the needle to travel in from one side through the material and down through the other side of the material panels, the sewer can join the two panels together.

More recently, sewing machines have been used to sew pliable panels together. To sew thicker materials such as leather, large industrial sewing machines are needed, or a person can hand sew the panels together using a strong needle. In either case, when the sewing task is completed, the line of stitches is intermittent, which is effective for holding the two pieces of material together but not necessarily the most ideal from a visual standpoint. A seemingly continuous line of stitching may be preferable in certain circumstances such as in the making of sewn leather wallets, bags or purses. Moreover, it would be beneficial if an evenly spaced row or rows of apertures are laser cut into the material before the hand stitching activity begins thereby insuring a perfectly straight row of stitches forming a seemingly continuous line.

Current methods of hand sewing have not foreseen this novel approach to forming a perfect, seemingly continuous line of stitching to hold both pliable panels and hard panels together.

BRIEF SUMMARY OF THE INSTANT INVENTION

The primary object of the invention is to provide a method for attaching both pliable panels and hard panel pieces together in an orderly and decorative manor.

Another object of the invention is to provide a panel sewing technique that results in a seemingly uninterrupted line of sewn thread Another object of the invention is to provide a pliable panel to hard panel attachment method that allows the surface of a hard panel to be seen through cutouts in the surface of a pliable sheet of material.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a pliable panel and hard panel attachment methods comprising: a plurality of pliable panels, a thin metallic panel, a wood panel, a length of sewing thread the pliable panels being constructed of textile, leather or flexible plastic, the pliable panels having one or more rows of laser cut apertures that allow a length of the sewing thread to sew the pliable panels together, the hard thin metallic panel capable of being sandwiched between the pliable panel member the wood panel, the pliable panel members including laser cut apertures that allow the thin metal panel to be seen through the apertures and the pliable panel member, the metal panel member and the wood panel member held together by a standard fastening means at each corner of the panels.

BRIEF DESCRIPTION OF THE DRAWINGS

The drawings constitute a part of this specification and include exemplary embodiments to the instant invention, which may be embodied in various forms. It is to be understood that in some instances various aspects of the instant embodiments may be shown exaggerated or enlarged to facilitate an understanding of the instant embodiment.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
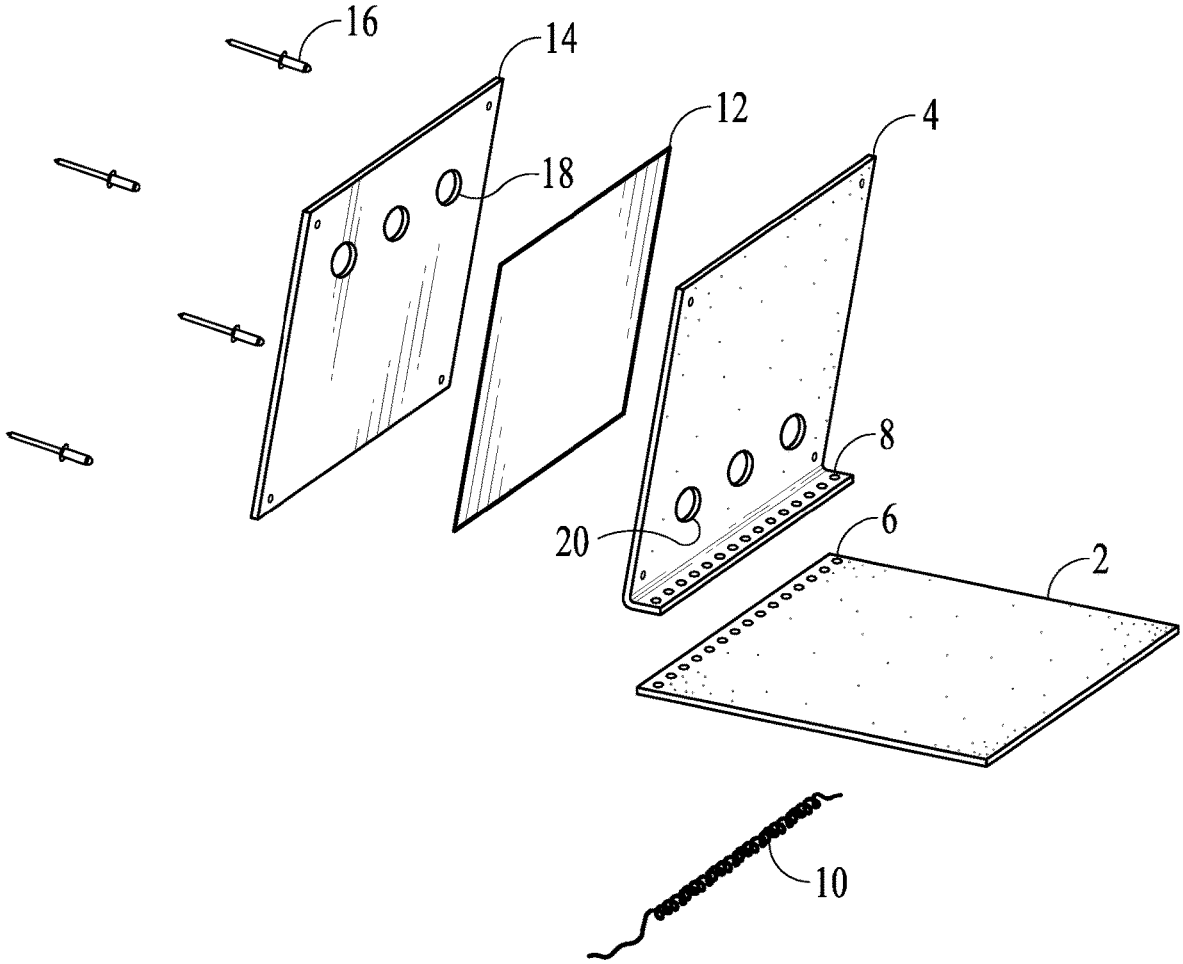
FIG. 1 is an exploded perspective view of the invention.

Referring now to FIG. 1 we see an exploded perspective view of pliable panels 2, 4, and hard panels 12, 14. The pliable panels are made of flexible material such as leather, vinyl, cloth or non-woven materials. The pliable panels 2, 4 have rows of apertures 6, 8 laser-cut into them. The apertures are evenly spaced. Sewing thread 10 can be used to hand sew the two panels 2, 4 together as will be shown in FIGS. 2 and 3. It is important to note that there is also the possibility of sewing a pliable panel to a hard panel if the hard panel had the prerequisite laser cut apertures. FIG. 1 also shows a thin metal panel 12 which will be sandwiched between a hardwooden panel 14 and pliable panel 4. The panels 14, 4 have apertures 18, 20 cut out of them so that the thin panel 12 can be seen through the apertures 18, 20 when all the panels are fastened together by fasteners 16 which may be rivets but can also be other standard fastening methods. The resulting product, such as a woman's purse, has the novel appearance of uniquely combining wood panels, metal panels and pliable panels where the metal can show through either the wood panel or the pliable panel.

Figure 2:
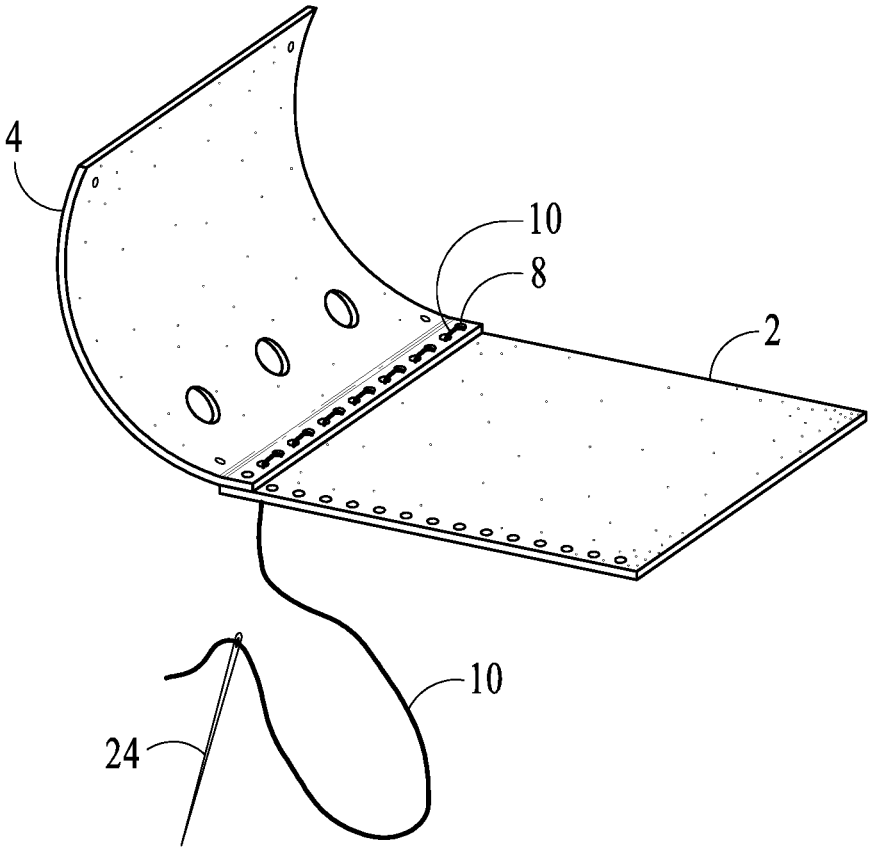
FIG. 2 is a perspective view of two pieces of pliable materials being sewn together.

FIG. 2 is a perspective view of panels 2 and 4 being sewn together. Thread 10 and needle 24 travel in and out of apertures 8 forming an intermittent line of stitches 10.

Figure 3:
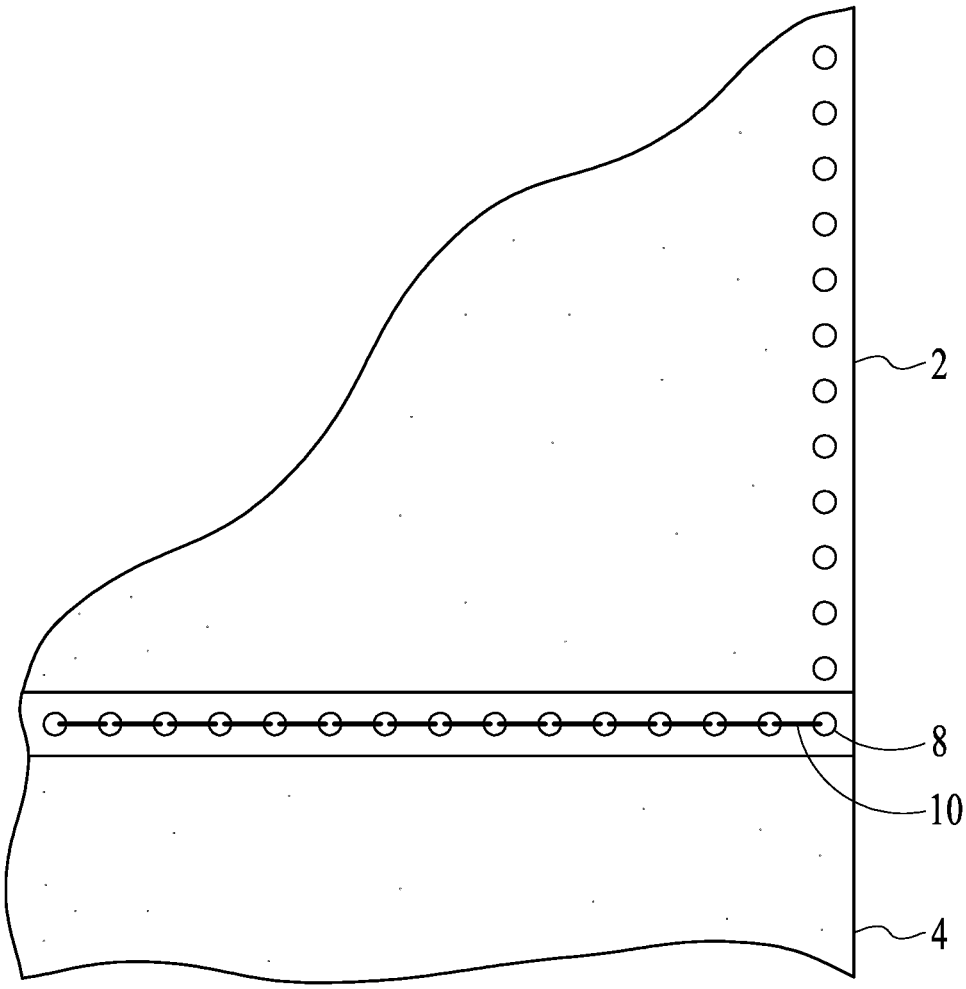
FIG. 3 is a plan view of two pieces of pliable materials fully sewn together producing a seemingly uninterrupted line of sewing.

FIG. 3 is a plan view showing the completed stitching where the thread has been inserted again into the apertures 8 to fill in the spaces between the thread as shown in FIG. 2. This novel sewing technique creates a seemingly continuous line of stitches which can add a unique look to sewn items such as wallets, bags or purses.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method of attaching a plurality of pliable panels to a plurality of hard panels in a decorative manner:

wherein the plurality of hard panels comprise a thin metallic panel and a wood panel;

wherein the plurality of pliable panels comprise one or more rows of a plurality of laser cut apertures, wherein furthermore one of the plurality of pliable panels comprises a plurality of decorative apertures;

wherein the thin metallic panel is located on the pliable panel in a manner exposing the thin metallic panel through the plurality of decorative apertures;

wherein the wood panel is located over the thin metallic panel;

wherein one or more pliable panels without the decorative apertures is located over the wood panel;

wherein the pliable panels and the wood panel are sewn together with a length of sewing thread resulting in a pattern;

wherein the pliable panels being constructed of fabric, leather or flexible plastic; and wherein the pliable panels, the metal panel member and the wood panel member being held together at each corner of the panel by fasteners.

2. A method of attaching a plurality of pliable panels to a plurality of hard panels as claimed in claim 1 wherein the sewing thread is inserted into the row of apertures in such a way that the resulting sewn pattern appears to be a continuous line of thread.

3. A method of attaching a plurality of pliable panels to a plurality of hard panels as claimed in claim 1 wherein the pliable panels and the wood panel are fastened together by a plurality of rivets.

* * * * *